US005261653A

United States Patent [19]

Chang

[11] Patent Number: 5,261,653

[45] Date of Patent: Nov. 16, 1993

[54] HIGH CAPACITY SHEET FEEDER

[75] Inventor: Joseph Chang, Hsin-Chu, Taiwan

[73] Assignee: Advanced Scientific Corp., Taiwan, Taiwan

[21] Appl. No.: 948,174

[22] Filed: Sep. 18, 1992

[51] Int. Cl.[5] ..... B65H 1/18

[52] U.S. Cl. ..... 271/126; 271/155

[58] Field of Search ..... 271/126, 152, 154, 155

[56] References Cited

U.S. PATENT DOCUMENTS

| | | | |
|---|---|---|---|
| 4,461,466 | 7/1984 | Uchida | 271/126 X |
| 4,852,869 | 8/1989 | Watanabe | 271/155 X |
| 4,976,421 | 12/1990 | Kanaya | 271/155 |

*Primary Examiner*—Richard A. Schacher

*Attorney, Agent, or Firm*—W. Wayne Liauh

[57] ABSTRACT

This invention discloses a sheet feeder which comprises a plurality of micro switches, a light sensitive switch, and a controller board having an erasable programmable read only memory (EPROM) for receiving signals from the micro switch and sending pre-programmed responses to control the movement a pair of motors which in turn cause a paper carrying elevator to ascend and send the feed paper sheets into a laser printer. The capacity of the sheet feeder of this invention is several times that of a conventional tray-shaped sheet feeder. The front face of this sheet feeder is provided with a receiving rack, each of whose two ends is furnished with an oblong hole. A sheet guide is pivotally connected to the sheet feeder using two small round bolts inserted through the two oblong holes respectively. The height of the sheet guide can be adjusted within a given limit to accommodate the varying feeding port height of a wide variety of laser printers. The sheet guide can be folded down completely against the front face of the sheet feeder to provide packing and shipping convenience.

4 Claims, 3 Drawing Sheets

HIGH CAPACITY SHEET FEEDER

BACKGROUND OF THE INVENTION

This invention relates to a paper feeder for use with a laser printer. More particularly, this invention relates to high capacity paper feeder that can be adapted for use with a wide variety of laser printers of different makes and models and provide a feeding capacity in excess of fifteen hundred sheets of printing paper.

Due to the proliferation of personal computers, laser printers have become one of the most popular equipment in today's office environment. One of the main advantages of laser printers is their ability to provide very high quality printing in a minimal amount of time. Although laser printers have seen significant improvements most notably in the areas of built-in fonts and printing speed, most of the paper feeders, which are in the form of paper trays, remain largely unchanged form those used in the early models and provide only relatively limited feeding capacity. The increase in printing speed results in an increased frequency at which the paper tray must be replenished. Furthermore, in order to save capital cost and office space, several computers are often connected to the same laser printer and share the printing load therewith. This further increases the frequency at which the paper tray must be refilled.

Unlike dot matrix printers, which can receive a continuous roll of paper having perforated edges, a laser printer can be fed only on a sheet-by-sheet basis. Currently, the paper sheets to be fed into the laser printer are stored in a paper tray attached to the feeding port of the laser printer. Due to the weight exerted by the paper sheets, the capacity of a paper tray can not be significantly increased over the current capacity. Most of the commercially available laser printer paper trays have a capacity of approximately two hundred (200) sheets of paper. For a new model laser printer, the speed of printing can be more than eleven (11) sheets per minute, as opposed to four (4) sheets per minute for the older models. This means that the paper tray will be emptied every twenty minutes when the laser printer is operating at full speed. To avoid office interruptions due to the laser printer running out of paper, the paper tray must be frequently inspected and refilled to make sure that it has enough paper to satisfy the printing need. Such a limitation is very inconvenient to laser printer users and has become one of the main bottlenecks in today's high-tech office environment.

Another problem arises when attempting to develop an "add-on" sheet feeder for laser printers. Different makes and models of laser printers that using same printer engine are often manufactured having sheet feedings port at similar height. For example, the laser printers that using Canon SX printer engine have approximately the same height for its sheet feeding port such as the following laser printers: Hewlett Packard laser Jet III and IIID, Laser Jet II, and IID, Apple Laser Writer Series II, Canon LBP-8 II, III, Brother HL-8 and HL-8E, Wang LDP8, and QMS PS810, PS820, and PS825, to name a few. However, although most of the sheet feeding ports are similar in height, there is still a range of difference of approximately 15 mm among various laser printers. This difference in height could cause difficulties in attempts to provide a sheet feeder that is to be universally adaptable for use with laser printers of different brand.

SUMMARY OF THE INVENTION

Having discussed the shortcomings of current laser printing operations, the primary object of this invention, therefor, is to provide a high capacity sheet feeder for use with laser printers. More particularly, the primary object of this invention is to provide a microprocessor-controlled laser printer sheet feeder which has a feeding capacity in excess of fifteen hundred sheets of paper and is capable of providing at least two hours of continuous and uninterrupted printing operations.

Another object of this invention is to provide a sheet feeder that can be adapted for use with a wide variety of laser printers whose feeding ports are at similar but not exact the same heights.

This invention discloses a microprocessor-controlled sheet feeder having a pivotable height adjusting means to adapt to the sheet feeding port of different model laser printers having different heights, thereby making it universally compatible with a wide variety of laser printers.

The present invention mainly comprises a paper carrying elevator, a pair of motors for vertically moving the paper carrying elevator and for delivering feed paper to the laser printer, respectively, a plurality of micro-switches, a light sensitive switch, and controller board with an erasable programmable read only memory (EPROM) for receiving signals from various switches and sending preprogrammed responding signals to control the motors, which can cause the paper carrying elevator to move upward so as to feed the paper into a laser printer after the laser printer is prompted to print. The load capacity of the present invention is several times that of a conventional tray-shaped sheet feeder. The front face of the sheet feeder has a receiving rack with as oblong holes on each of its two ends, to facilitate a sheet guide to be connected with the sheet feeder by means of two round bolts fitted through the two oblong holes respectively. The sheet guide can be pivotally adjusted up or down within a given limit to fit the height of the sheet feeding port of the laser printer. The sheet guide can also be folded downward against the front face the sheet feeder to provide convenience in packing and shipping thereof.

DESCRIPTION OF THE PREFERRED EMBODIMENT

Figure 1:
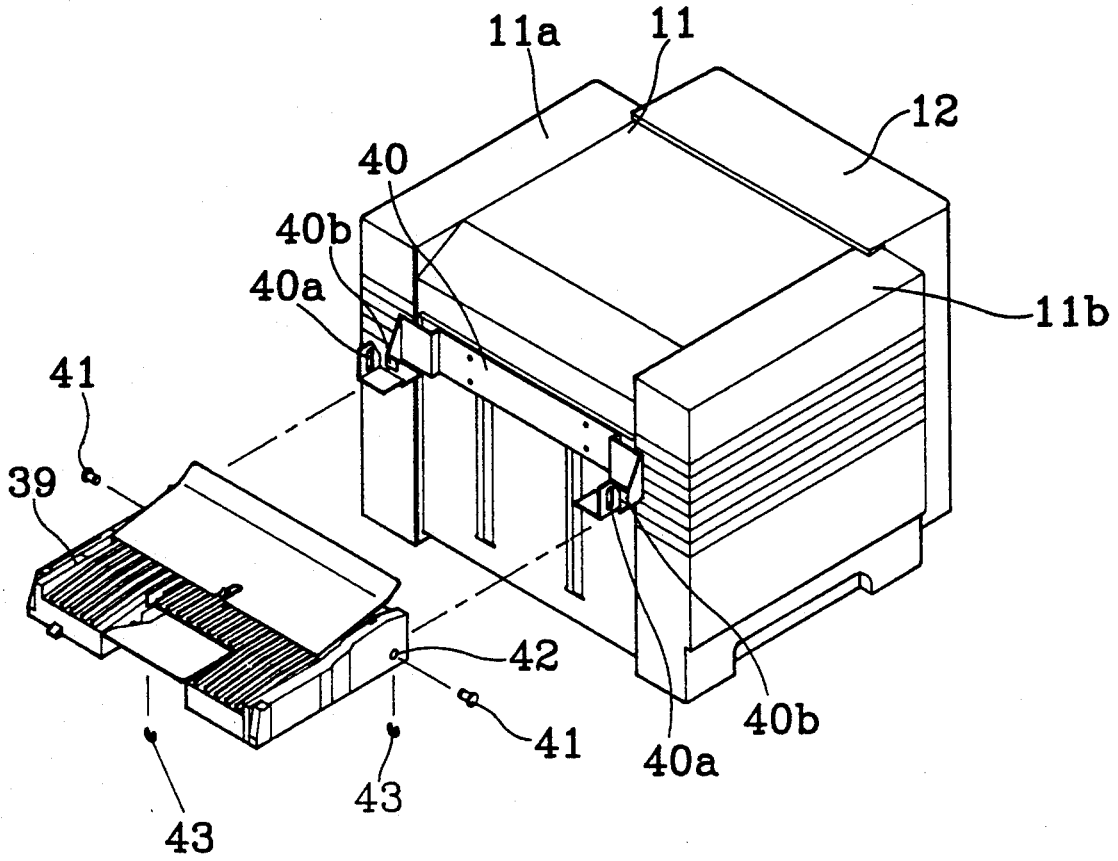
FIG. 1 is a perspective view of a preferred embodiment of the present invention.
Figure 2:
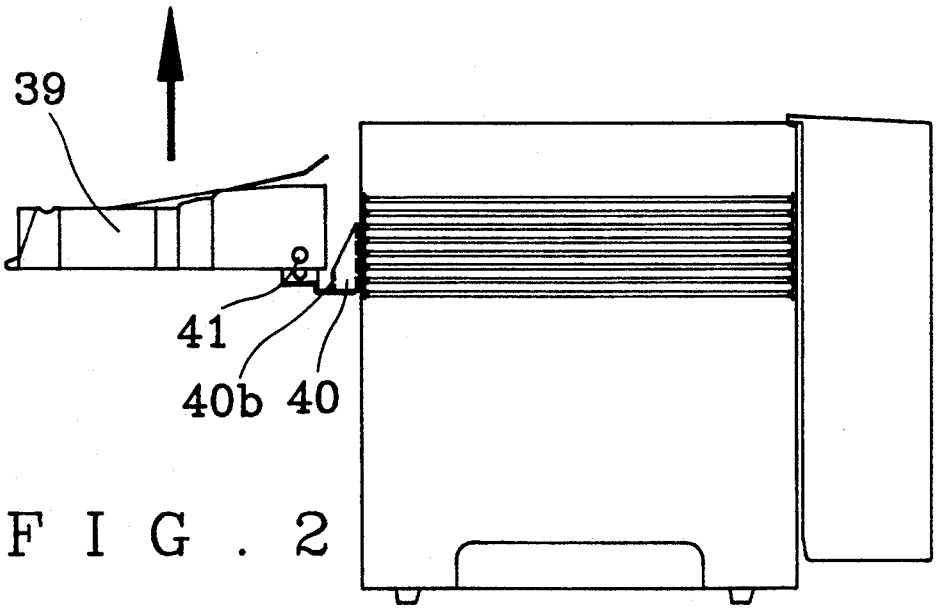
FIG. 2 is a side view of the present invention depicting a sheet guide being mounted in place.

Referring now to FIG. 1, the receiving rack 40 of the present invention is made of stainless steel, or any suitable material, and both sides thereof are in symmetrical shape; the receiving rack 40 is to be attached to the front end of the sheet feeder body by means of four screws. The receiving rack 40 has an oblong hole 40*a* and a guard plate 40*b* at each end thereof. A sheet guide 39 is mounted to the receiving rack 40 by means of two small round bolts 41, which are to be inserted through two round holes 42, respectively, in the sheet guide 39 and the two oblong holes 40*a* in the receiving rack. Each of the small round bolts are fastened in place with an E-shaped retaining ring 43. According to the aforesaid structure, the small round bolts 41 can be moved up and down within the oblong holes 40*a* respectively. The sheet guide can be pivoted at a selected angle by using the small round bolts 41 as pivots, and using the guard plates 40*b* as lifting members; therefore, the front end of the sheet guide is allowed to have an up and down movement space of about 25 mm so as to be compatible with different models of laser printers having different heights. Referring now to FIG. 2, the front end of the sheet guide is designed having a shape adapted is to fit the sheet feeding port of a laser printer. The sheet guide can be mounted in place by attaching it to the receiving rack 40 and pushing it into the sheet feeding port of a laser printer, in a procedure similar to a conventional tray-shaped sheet feeder.

Figure 3:
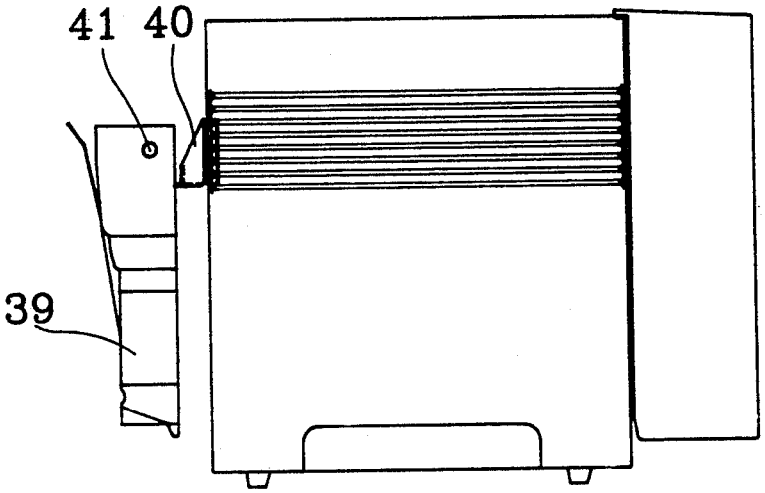
FIG. 3 illustrates the sheet guide of the present invention being set at a recovered position.

The sheet guide 39 can be folded to provide convenience in storage and shipping. The sheet guide 39 can be lifted upward within space of the oblong holes so that the bottom of the sheet guide 39 will not touch the guard plate 40*b* when the sheet guide makes a 90 degrees rotation about the small round bolts 41 toward the guard plate 40*b*. Using the two small round bolts 41 as pivotal support, the sheet guide can be folded against the front face of the sheet feeder. The whole sheet feeder can then be conveniently packed for shipping as shown in FIG. 3.

Figure 4:
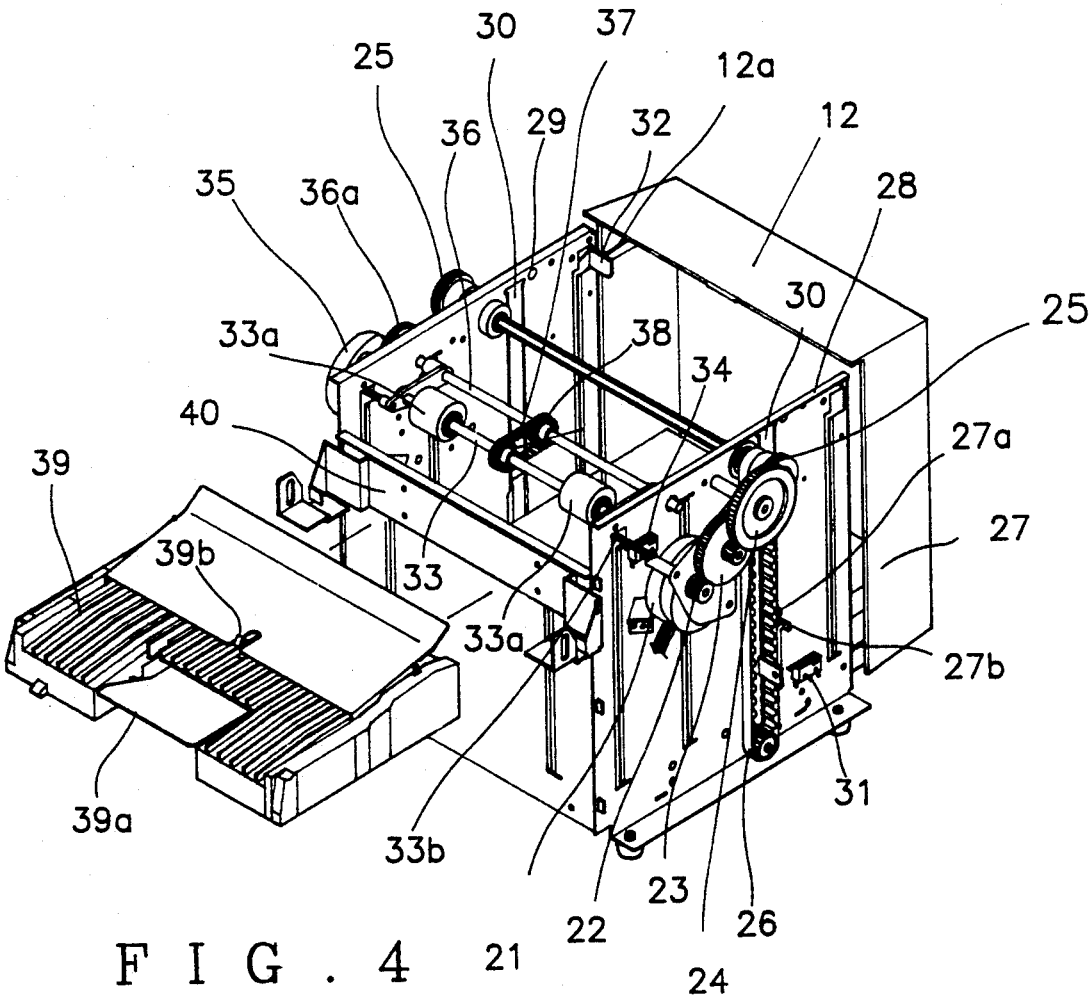
FIG. 4 is a perspective view showing the inner structure of the present invention.
Figure 5:
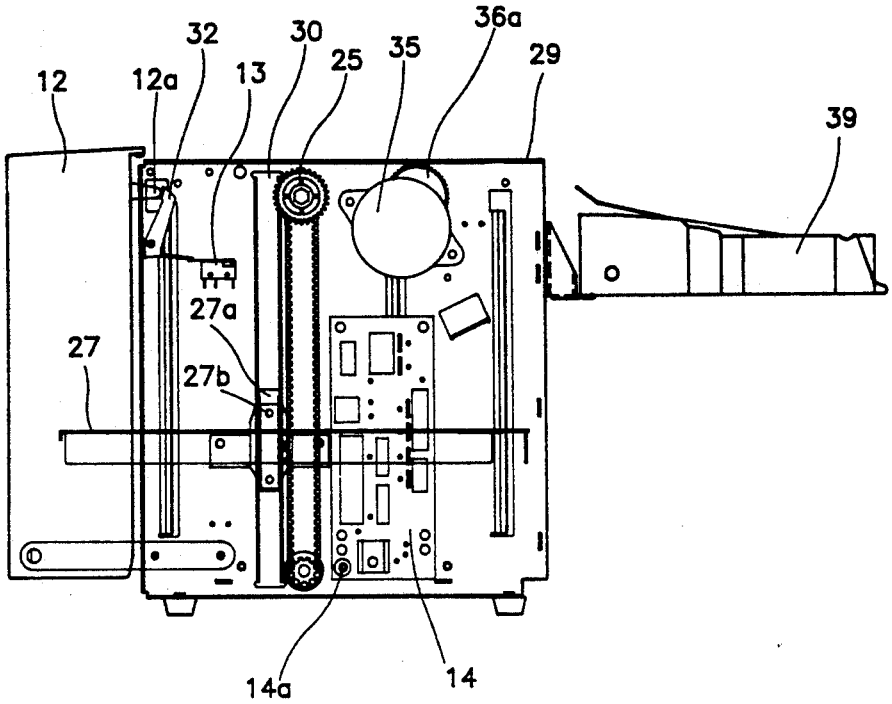
FIG. 5 is a right side view of the inner structure of the present invention.

FIG. 4 illustrates the inner structure of the present invention after all the outer lids 11, 11*a* and 11*b* (which are shown in FIG. 1) have been removed. FIG. 5 is a right side view if the inner structure of the present invention in which the microprocessor controller board 14 has an erasable programmable read only memory (EPROM), for receiving signals from the micro switch and the light sensitive switch 39*b*, which controls the running time and direction of the motor 35. It is well-known in the art to use a timer switch to control the running time of motor 35. It is also well-known in the art to use an on/off switch to control the running direction of motor 21 for moving a paper carrying elevator up and down. In order to improve paper feeding reliability lower the manufacturing cost and reduce the dimensions of the machine, the previous function programs have been permanently stored in the EPROM of the microprocessor controller board according to the present invention. This is a common technique in the electronic industry.

Figure 6:
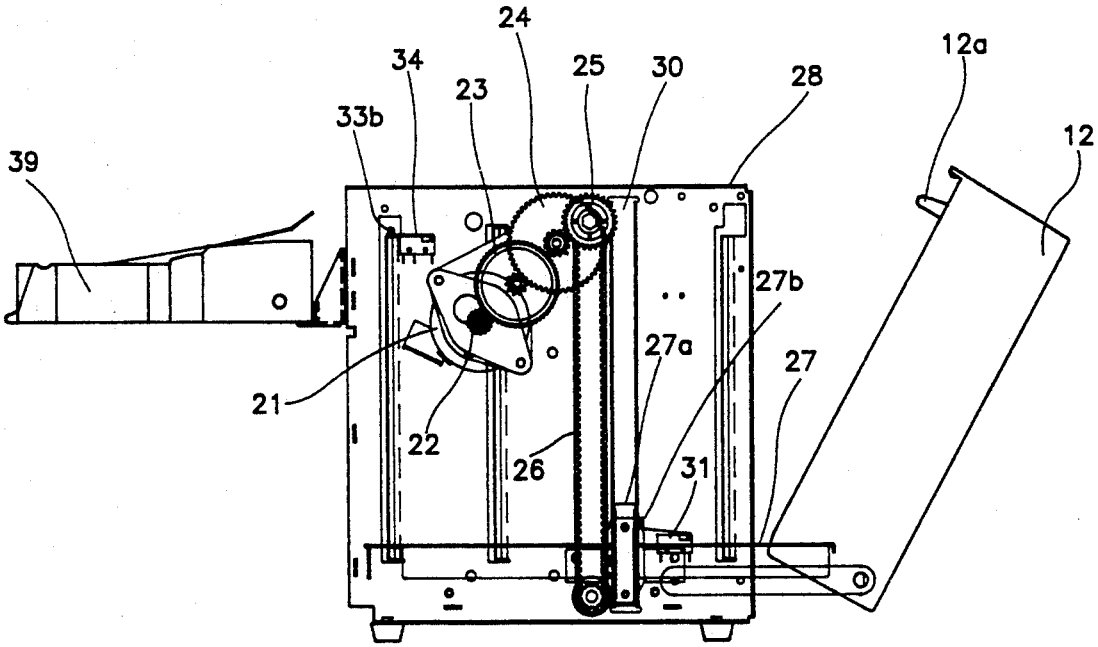
FIG. 6 is a left side view of the inner structure of the present invention.

As described in FIG. 5, the power supply is connected to a power supply inlet 14*a* on the controller board 14; the right upper corner of the rear lid has an arm 12*a* to contact against a movable metal piece 32, which presses a micro switch 13 by means of a lever function. As soon as the rear lid 12 is opened, the micro switch 13 is turned on, and a signal will be transmitted to the controller board 14 to activate a motor 21 to rotate reversely (as shown in FIG. 6). Through the transmission function of gears 22, 23, 24 and 25, and a timing transmission belt 26, the paper carrying elevator 27 will move downwards. Both sides of the paper carrying elevator 27 are fixed and attached with two plastic sliding blocks 27 a respectively, so that the paper carrying elevator can move up and down along a guide slot 30 in a left supporting plate 28 and guide slot 30 in a right support plate 29. A fixed metal piece 27*b* is used to fix the timing transmission belt 26 and the plastic sliding block 27 a together. When the timing transmission belt 26 is moving, the paper carrying elevator 27 will be moved downwards. When the elevator 27 is moved to the bottom position, the fixing metal piece 27*b* on the left side of the machine will press a micro switch 31, which will send a signal to the controller board 14 to stop motor 21.

Referring now to FIG. 5, after a user puts paper sheets on the paper carrying elevator 27, the rear lid 12 is then closed. The movable metal piece 32 will press on a micro switch 13, and a signal is sent to the controller board 14 to start motor 21 to rotate forwards so as to have the paper carrying elevator 27 to ascend. In this case, the paper sheets will also move upwards until touching against two rollers 33*a*, which will also be pushed upwards. Finally two small round rods 33*b*, which are normally pressed against a micro switch 34, on both ends of the roller shaft 33 are also pushes upwards to cause the micro switch 34 to be turned off, and a signal will be sent to the controller board 14 to stop the motor 21. A motor 35 is simultaneously started to actuate a gear 36*a*, a driving shaft 36, two sprocket gears 38, a chain 37 and a roller shaft 33, and then a sheet of paper is fed along the sheet guide 39 to a positioning piece 39*a*. Since the running time of motor 35 is controlled by the controller board, the motor 35 will be stopped on the paper sheet reaching the position piece so as to be ready for use by a laser printer.

The paper sheets in the sheet guide are loaded and pressed on a light sensitive switch 39*b*. When the laser printer pulls a sheet away, the light sensitive switch 39*b* will be turned on to send a signal to the controller board 14, which will again start the motor 35 to feed a second sheet. After the previous feeding steps, a number of sheets will be fed, and the rollers 33*a* and the roller shaft 33 will gradually be moved to a lower position. As a result, the small round rods 33*b* fixed on both ends of the roller shaft 33 will press a micro switch 34 to the on position. A signal will then be sent to the controller board 14 to cause the motor 21 to rotate forwards so as to have the paper carrying elevator 27 ascend again, then the rollers 33*a*, the roller shaft 33 and the two small round rods 33*b* will also be moved upwards. Finally the micro switch 34 previously pressed by the small round rods 33*b* will be turned off, and signal is then sent to the controller board 14 causing the motor 21 to stop. The motor 35 is simultaneously started to rotate, and then a sheet of paper is fed; the same steps are repeated continuously until all sheets have been used. As soon as the last sheet is pulled away by the laser printer, the motor 35 can still be started. Since there is no sheet to be sent out, the paper carrying elevator will move downwards to be ready for loading the next batch of paper sheets. Through actual tests, the outer dimensions of the embodiment, excluding the sheet guide, are 32 cm×33 cm×26 cm. One batch of 1500 sheets can be loaded each time. This amount is more than seven (7) times the capacity of a conventional tray shaped sheet feeder, and is deemed a great improvement in terms of convenience for the user.

Since many possible embodiments may be made of the invention without departing from the scope thereof, it is to be understood that all matters herein set forth or shown in the accompanying are to be interpreted as illustrative and not in a limiting sense per view of the invention as specified in the appended claims.

What is claimed is:

1. A high capacity sheet feeder adapted for use with a laser printer, comprising:

(a) a paper carrying elevator;

(b) a first motor to cause said paper carrying elevator to move upward and downward;

(c) a host computer board;

(d) a plurality of micro switches in cooperation with said host computer board for controlling the upward or downward movement of said first motor;

(e) a second motor for delivering paper from said sheet feeder to said laser printer;

(f) a sheet guide for directing said paper from said sheet feeder to a feeding port of said laser printer;

(g) a light sensitive switch in said sheet guide, which, in cooperation with said host computer board, will actuate said second motor; and (h) an adjusting means for pivotally adjusting said sheet guide so as to allow said sheet feeder adaptable for use with a wide variety of laser printers having feeding ports at varying heights.

2. The high capacity sheet feeder of claim 1 wherein said host computer board contains a built-in program for carrying out pre-determined operations.

3. The high capacity sheet feeder of claim 2 wherein said built-in program is provided in the form of an erasable programmable read-only memory, or EPROM.

4. The capacity sheet feeder of claim 1 wherein said adjusting means comprises:

(a) a receiving rack fixedly mounted on said sheet feeder;

(b) an oblong hole at each end of said receiving rack;

(c) a pair of round holes in said sheet guide, each of said round holes is disposed so as to match a corresponding said oblong hole in said receiving rack;

(d) a pair of round bolts, each of said round bolts being adapted to tie one of said round holes with a corresponding oblong hole thereby affixing said sheet guide to said receiving rack while allowing said sheet guide to pivot about said round bolts; and (e) a pair of E-shaped retaining rings for fastening said round bolts in place.

* * * * *